United States Patent [19]

Ameen et al.

[11] Patent Number: 4,514,232

[45] Date of Patent: Apr. 30, 1985

[54] PROCESS FOR STRIPPING SILICON OIL BASE THERMAL GREASE

[75] Inventors: Joseph G. Ameen, Apalachin, N.Y.; Richard H. Hogrogian, Oakland, N.J.; Samuel L. Smey, Binghamton, N.Y.

[73] Assignee: International Business Machines Corporation, Armonk, N.Y.

[21] Appl. No.: 449,941

[22] Filed: Dec. 15, 1982

[51] Int. Cl.[3] ..... B08B 3/12

[52] U.S. Cl. ..... 134/1; 134/26; 134/40; 252/158

[58] Field of Search ..... 134/1, 26, 40, 38; 252/158, DIG. 8

[56] References Cited

U.S. PATENT DOCUMENTS

| | | | |
|---|---|---|---|
| 2,897,104 | 7/1959 | Duncan | 252/158 |
| 3,454,428 | 7/1969 | Hittel et al. | 134/1 |
| 3,551,204 | 8/1967 | Bolger et al. | 134/42 |
| 4,276,186 | 6/1981 | Bakos et al. | 134/40 |

FOREIGN PATENT DOCUMENTS

| | | | |
|---|---|---|---|
| 128834 | 10/1980 | Japan | 134/1 |

OTHER PUBLICATIONS

Galloway et al., "Nylon Stripping From Substrates" IBM Technical Disclosure Bulletin, vol. 16, No. 1, Jun. 1983.

Williams et al., "A Method of Cleaning Low Scatter Mirrors After Exposure to Silicon Oil" Conference Proceedings of Society of Photooptical Instrumentation, vol. 107, Apr. 1977.

Bennett, *The Chemical Formulary,* 1965, vol. XI, p. 314, vol. XIII, pp. 196, 371.

*Primary Examiner*—S. Leon Bashore
*Assistant Examiner*—K. M. Hastings
*Attorney, Agent, or Firm*—John H. Bouchard

[57] ABSTRACT

The use of an ultrasonically agitated solution which includes UNRESOLVE PLUS and methylene chloride and acetic acid to strip a silicone oil base grease from module caps. The caps are placed in a container of the solution and agitated. They are then removed, water rinsed, and blown dry.

2 Claims, No Drawings

PROCESS FOR STRIPPING SILICON OIL BASE THERMAL GREASE

BACKGROUND OF THE INVENTION

In the printed circuit packaging technology, an integrated circuit module is provided which includes a conventional ceramic substrate on which is mounted at least one integrated circuit chip. The integrated circuit chip has solder connections to circuitry on the ceramic substrate and the module has a plurality of conventional pins which make circuit connections to external circuitry.

A cap, which may be provided with heat sink fins, is secured to the top surface of the substrate with a solder or organic sealing material to form a hermatic seal. A suitable medium, such as thermal grease, is provided between the circuit chip and the cap to lower the thermal impedance between the chip and cap to enhance the cooling of the circuit chip during circuit operation. A circuit module of the type described is disclosed in the IBM Technical Disclosure Bulletin, Vol. 21, No. 3, August 1978, page 1064.

Suitable nozzle dispensing apparatus is used to deposit the thermal grease on the inside of the cap and in a position where it fully contacts the circuit chip when the cap is sealed to the module. Subsequent electrical testing of the module will give unsatisfactory results if the thermal grease is out of position or if the composition of the grease changes due to contamination from an unclean nozzle. As a result, the cap had to be removed and replaced by a new one which resulted in undesirable expense. Subsequently, a thermal grease was developed which consists of boron nitride and mineral oil and which could be readily dissolved by chlorinated solvents or polar organic salts. A thermal grease of this type is disclosed in U.S. Pat. No. 3,405,066. This enabled the cap to be removed, the grease dissolved, and the cap reused. However, it was found that the boron nitride and mineral oil grease had some disadvantages. This grease has a tendency to corrode if the module cap is not completely sealed tight and as a result carbon dioxide filtrates in and causes lead carbonate. Also, the composition is not stable in that the boron nitride particles tend to separate from the oil base and the grease has to be reworked to maintain its grade.

Subsequently, a thermal silicone oil base grease was developed which consists of silicone oil, zinc oxide, and fumed silica. This type of thermal grease, which is disclosed in U.S. Pat. No. 4,265,775, issued to the common assignee, solved the above-mentioned corrosion problem and proved to be safe and stable and could be stored under ambient conditions for approximately two and one half years. However, there was no known process which was capable of dissolving or stripping this type of thermal grease from a module cap so that the cap could be used again. The reason for this is that the zinc oxide particles could not be satisfactorily removed and also the silicone oil base strongly adheres to metal. It became evident that such a process was needed in order to take advantage of the superior qualities of the silicone grease.

SUMMARY OF THE INVENTION

The present invention provides a process for stripping the aforementioned silicone thermal grease from module caps. The process comprises mixing a solution of URESOLVE PLUS, a proprietary product of Dynalloy, Inc., and methylene chloride. A beaker of this solution is placed on a bench top ultrasonic unit. The caps having the thermal grease to be removed are placed in the solution and ultrasonically agitated. The caps are then removed, water rinsed and blown dry. It was found that the ultrasonic agitation helps remove the zinc oxide particles. This creates voids for the methylene chloride to dissolve the silicone oil. The methylene chloride plus agitation removes the bulk of the grease oxide particles leaving a thin tenacious film of silicone oil. URESOLVE PLUS agitation removes the silicone oil base. As a result, the inside of the cap has a water break-free surface, i.e. a clean surface with no beading due to the action of the URESOLVE. In the case where many caps are processed together, a zinc oxide film may form on the cap. Additional stripping and rinsing solutions are provided to remove this film.

Accordingly, a primary object of the present invention is to provide a novel and improved process for removing a thermal silicone oil base grease from metal caps.

Another object of the present invention is to provide a novel and improved process for removing a thermal silicone oil base grease from metal caps which includes agitating the caps in a solution of URESOLVE PLUS and methylene chloride.

A still further object is to provide a process as in the preceding object and including process steps for removing any zinc oxide formed on the processed caps.

The foregoing and other objects, features and advantages of the invention will be apparent from the following more particular description of a preferred embodiment of the invention.

DESCRIPTION OF PREFERRED EMBODIMENT

The thermal silicone oil base grease used on module caps and to which the present invention is applied has the following composition:

| | | |
|---|---|---|
| Carrier | Silicone Oil | 16.22% |
| Filler Material | Zinc Oxide | 83.45% |
| Anti-Bleed Agent | Fumed Silica | 0.33% |

As was previously mentioned, this grease is very difficult to remove and if not completely removed, it will interfere with subsequent module operations such as soldering.

In accordance with the present invention, the following process effectively removes the above-described silicone oil base grease from module caps:

1. Mix 10% by volume of URESOLVE PLUS and 90% by volume of methylene chloride. The essential elements of the URESOLVE PLUS composition comprise the following: approximately 60 to 80 percent by volume of ethylene glycol monomethyl ether, the remainder of the elements including wetting agents, color, oxygenated solvent, and a strong base.
2. Using a Sonicor bench top ultrasonic unit, a product of American Scientific Products, place a beaker containing the URESOLVE PLUS and methylene chloride in the ultrasonic unit.
3. Place the caps having the grease to be removed in the solution and ultrasonically agitate for one minute.
4. Remove caps, water rinse and then blow dry.

The methylene chloride is a chlorinated hydrocarbon solvent which when agitated is effective to remove the bulk of the grease zinc oxide particles and creates voids which allow it to dissolve the silicone oil base leaving a thin film which strongly adheres to the metal cap. URESOLVE PLUS is a depotting compound used to dissolve epoxies and also silicones. Further, agitation of the URESOLVE PLUS removes this thin silicone oil film. Evidence of the caps being clean was shown by the absence of water beading.

The process is described as using the preferred volume ratio of 10% URESOLVE PLUS and 90% methylene chloride. However, the process will work effectively using a volume range of 8–12% URESOLVE PLUS and 88–92% methylene chloride.

A beaker holding 300 cc of the solution was used for test purposes. It was found that up to 5 caps could be placed in the beaker and processed and good cleaning results were obtained. If more than 5 caps were placed in the beaker, a white zinc oxide film will redeposit on the cleaned caps. This film cannot be removed by water rinsing. Of course, if larger beakers are used with more solution, proportionally more caps will be effectively cleaned before the formation of the zinc oxide occurs. To remove the zinc oxide film when too many caps are processed together, one of the following options may be chosen:

| Solution 1 | Solution 2 | Comments |
|---|---|---|
| | Option 1 | |
| 10% URESOLVE PLUS 90% Methylene Chloride | 10–30% Nitric Acid | Can be used on chromated caps |
| | Option 2 | |
| 95 cc's of 10% URESOLVE PLUS and 90% Methylene Chloride plus 5 cc's of glacial acetic acid | 10% of URESOLVE PLUS and 90% Methylene Chloride | The zinc oxide oxide powder dissolves in solution 1 |
| | Option 3 | |
| 10% URESOLVE PLUS 90% Methylene Chloride | 10% URESOLVE PLUS 90% Methylene Chloride | Solution 1 is a sludge pot |

Solution 1 is a stripping solution and solution 2 is a rinsing solution. A final water rinse is used on all options. The option used depends on what surface the grease is on. For example, if the grease is to be removed from caps, options 1 or 2 may be used. If the grease is to be removed from chips on the substrates, option 3 is used. It should be noted that the ultrasonic unit used is not capable of removing chips from the substrates.

In summary, a process has been provided which effectively removes a silicone oil based thermal grease from metal caps leaving a water-break-free surface with no detrimental effects to the caps, substrates or chips.

While there has been described and pointed out the fundamental features of the invention as applied to the preferred embodiment, it will be understood that various omissions and substitutions and changes may be made in the form and details of the embodiment by those skilled in the art without departing from the spirit of the invention. It is the intention, therefore, to be limited only as indicated by the scope of the following claims.

What is claimed:

1. A process for stripping a silicone oil base thermal grease from circuit module caps which comprises the steps of:

mixing a solution of 8–12% by volume of a particular composition and 88–92% by volume of methylene chloride, said particular composition comprising 60–80% by volume of ethylene glycol monomethyl ether, the remainder of said composition comprising wetting agents, color, an oxygenated solvent, and a strong base;

placing said caps having said thermal grease in a container of said solution;

ultrasonically agitating said container of solution for one minute;

removing said caps from the container and subjecting them to water rinsing and air blow drying leaving a water-break-free surface;

immersing the cleaned caps in a first solution of 10% by volume of said particular composition and 90% by volume of methylene chloride and ultrasonically agitating the solution for one minute; and immersing said cleaned caps in a second solution of 10–30% by volume of nitric acid and ultrasonically agitating the solution for one minute.

2. A process for stripping a silicone oil base thermal grease from circuit module caps which comprises the steps of:

mixing a solution of 8–12% by volume of a particular composition and 88–92% by volume of methylene chloride, said particular composition comprising 60–80% by volume of ethylene glycol monomethyl ether, the remainder of said composition comprising wetting agents, color, oxygenated solvent, and a strong base;

placing said caps having said thermal grease in a container of said solution;

ultrasonically agitating said container of solution for one minute;

removing said caps from the container and subjected them to water rinsing and air blow drying leaving a water-break-free surface;

immersing the cleaned caps in a first solution of 90 ccs of 10% by volume of said particular composition and 90% by volume of methylene chloride plus 5 ccs of glacial acetic acid and ultrasonically agitating the solution for one minute; and immersing said cleaned caps in a second solution of 10% by volume of said particular composition and 90% by volume of methylene chloride and ultrasonically agitating the solution for one minute.

* * * * *